US006938951B1

(12) United States Patent
Tseng

(10) Patent No.: US 6,938,951 B1
(45) Date of Patent: Sep. 6, 2005

(54) FOLDABLE CHAIR WITH SAFETY LOCKS

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/997,491

(22) Filed: Nov. 23, 2004

(51) Int. Cl.[7] ..... A47C 4/48
(52) U.S. Cl. ..... 297/16.1; 297/56
(58) Field of Search ..... 297/16.1, 55, 56, 297/24, 25

(56) References Cited

U.S. PATENT DOCUMENTS 5,496,094 A * 3/1996 Schwartzkopf et al. ..... 297/45
6,092,866 A * 7/2000 Wu ..... 297/56
6,106,056 A * 8/2000 Wegner ..... 297/16.1
6,332,646 B1 * 12/2001 Tseng ..... 297/16.1
6,824,207 B1 * 11/2004 Lin ..... 297/16.1
6,840,573 B1 * 1/2005 Yao ..... 297/16.1

* cited by examiner

*Primary Examiner*—Peter R. Brown
(74) *Attorney, Agent, or Firm*—Ladas & Parry LLP

(57) ABSTRACT

A foldable chair includes first and second legs, a backrest, a seat-supporting frame, and a safety lock. The first and second legs are coupled pivotally to each other. The backrest is coupled pivotally to the second leg. The seat-supporting is coupled pivotally to the first leg and the backrest. The safety lock includes a pair of lock parts that are coupled pivotally to each other. The lock parts of the safety lock are coupled pivotally and respectively to the first and second legs.

2 Claims, 5 Drawing Sheets

FOLDABLE CHAIR WITH SAFETY LOCKS

BACKGROUND OF THE INVENTION

1. Field of the Invention

The invention relates to a foldable chair, more particularly to a foldable chair that has a relatively simple structure and that is safe to use.

2. Description of the Related Art

In U.S. Pat. No. 6,332,646, there is disclosed a conventional foldable chair that includes first and second legs, a backrest, and a seat-supporting frame. The first leg includes left and right leg parts, each of which has an end portion that is tubular and that is formed with a radial positioning hole. The backrest includes left and right backrest parts, each of which has an end portion. The end portion of each of the left and right backrest parts is inserted telescopically into the end portion of a respective one of the left and right leg parts of the first leg, and is provided with a resilient positioning protrusion that projects radially into the positioning hole in the end portion of the respective one of the left and right leg parts of the first leg.

To fold the conventional foldable chair, the positioning protrusions are depressed to respectively disengage the positioning protrusions from the positioning holes, thereby permitting the backrest to retract into the first leg. As a result, the first and second legs can be folded toward the seat-supporting frame.

Although the aforesaid conventional foldable chair achieves its intended purpose, since the folding operation of the conventional foldable chair requires simultaneous depressing of the positioning protrusions, the folding operation of the conventional foldable chair is relatively inconvenient to perform. Furthermore, when a person is seated on the foldable chair, and when the positioning protrusions are accidentally depressed, the conventional foldable chair may undesirably fold. This poses a danger to the user.

SUMMARY OF THE INVENTION

Therefore, the object of the present invention is to provide a foldable chair that has a relatively simple structure and that is safe to use.

According to the present invention, a foldable chair comprises first and second legs, a backrest, a seat-supporting frame, and first and second safety locks. The first leg includes left and right leg parts, each of which has first and second end portions and a pivot portion between the first and second end portions of a respective one of the left and right leg parts of the first leg. The second leg includes left and right leg parts, each of which has first and second end portions and a pivot portion between the first and second end portions of a respective one of the left and right leg parts of the second leg. The pivot portion of each of the left and right leg parts of the second leg is coupled pivotally to the pivot portion of a respective one of the left and right leg parts of the first leg. The backrest includes elongate left and right backrest parts, each of which has first and second end portions. The first end portion of each of the elongate left and right backrest parts is coupled pivotally to the second end portion of a respective one of the left and right leg parts of the second leg. The seat-supporting frame has first and second end portions, and an intermediate portion that interconnects the first and second end portions of the seat-supporting frame. Each of the first and second end portions of the seat-supporting frame is coupled pivotally to the second end portion of a respective one of the left and right leg parts of the first leg. The intermediate portion of the seat-supporting frame is coupled pivotally to the second end portions of the elongate left and right backrest parts of the backrest. Each of the first and second safety locks prevents accidental folding of the foldable chair, and includes a pair of lock parts that are coupled pivotally to each other. One of the lock parts of the first safety lock is coupled pivotally to the left leg part of the first leg at a position between the second end portion and the pivot portion of the left leg part of the first leg. The other of the lock parts of the first safety lock is coupled pivotally to the second end portion of the left leg part of the second leg. One of the lock parts of the second safety lock is coupled pivotally to the right leg part of the first leg at a position between the second end portion and the pivot portion of the right leg part of the first leg. The other of the lock parts of the second safety lock is coupled pivotally to the second end portion of the right leg part of the second leg.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
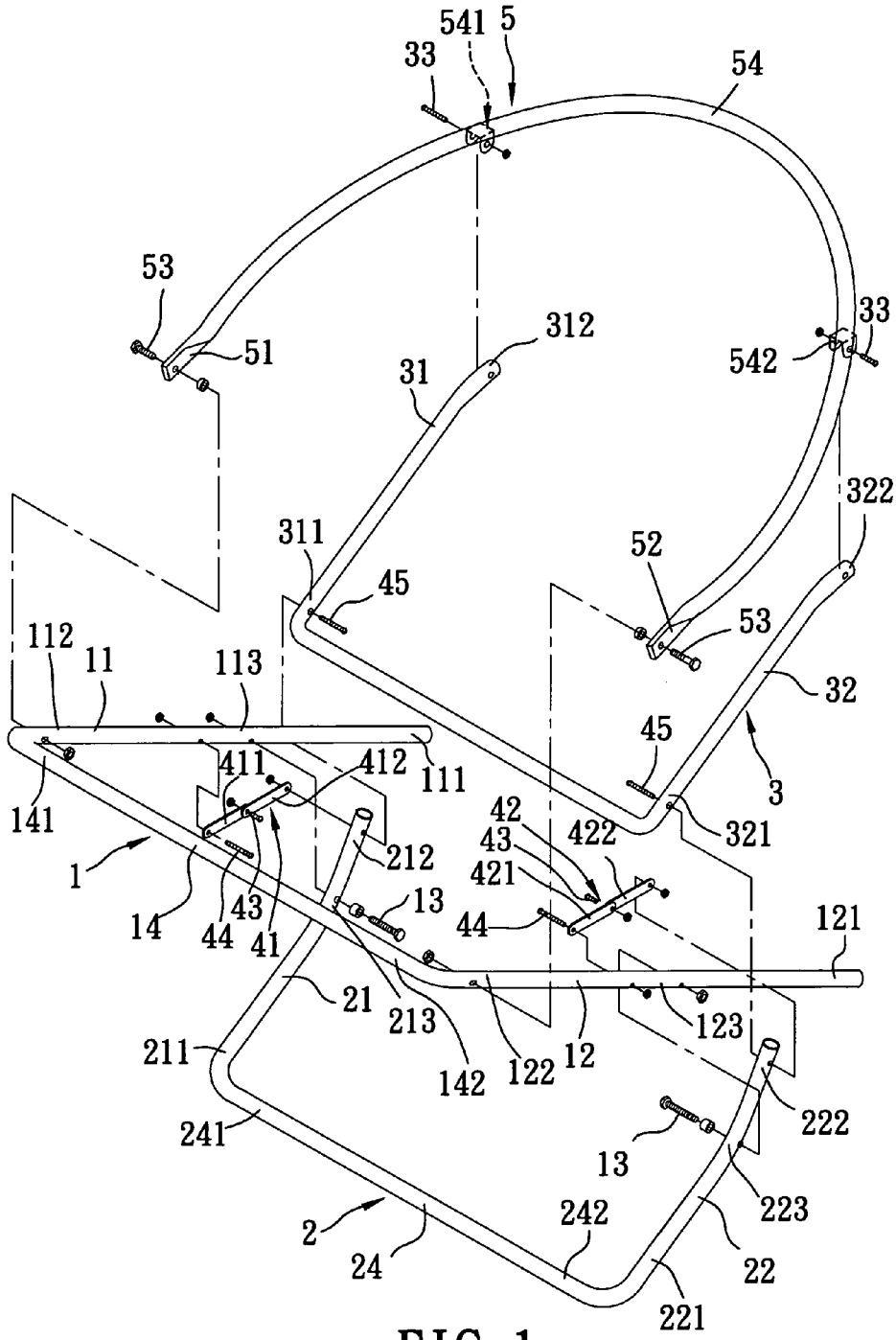
FIG. 1 is an exploded perspective view of the preferred embodiment of a foldable chair according to the present invention.
Figure 2:
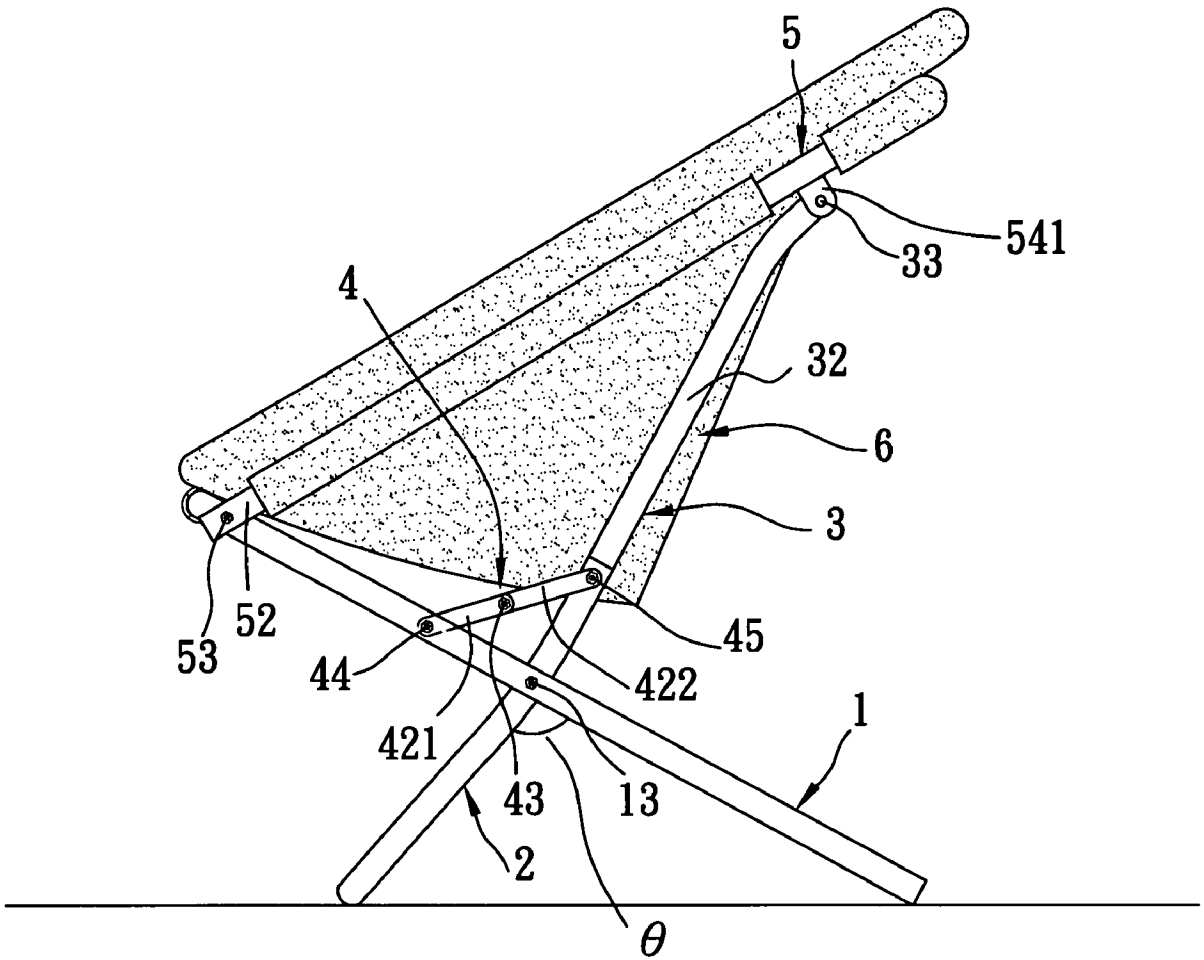
FIG. 2 is a schematic side view of the preferred embodiment to illustrate an unfolded state thereof.

Referring to FIGS. 1 and 2, the preferred embodiment of a foldable chair according to this invention is shown to include a first leg 1, a second leg 2, a backrest 3, a seat-supporting frame 5, and first and second safety locks 41, 42.

The first leg 1 includes left and right leg parts 11, 12, each of which has first and second end portions 111, 112, 121, 122 and a pivot portion 113, 123 between the first and second end portions 111, 112, 121, 122 of a respective one of the left and right leg parts 11, 12 of the first leg 1.

The second leg 2 includes left and right leg parts 21, 22, each of which has first and second end portions 211, 212, 221, 222 and a pivot portion 213, 223 between the first and second end portions 211, 212, 221, 222 of a respective one of the left and right leg parts 21, 22 of the second leg 2. The pivot portion 213, 223 of each of the left and right leg parts 21, 22 of the second leg 2 is coupled pivotally to the pivot portion 113, 123 of a respective one of the left and right leg parts 11, 12 of the first leg 1.

The foldable chair further includes a pair of first pivot joints 13. One of the first pivot joints 13 interconnects the left leg part 11 of the first leg 1 and the left leg part 21 of the second leg 2. The other of the first pivot joints 13 interconnects the right leg part 12 of the first leg 1 and the right leg part 22 of the second leg 2. In this embodiment, each of the first pivot joints 13 includes a bolt and a nut. In an alternative embodiment, each of the first pivot joints 13 includes a rivet.

The second leg 2 further includes a crosspiece 24 that has first and second end portions 241, 242, each of which is connected to the first end portion 211, 221 of a respective one of the left and right leg parts 21, 22 of the second leg 2.

It is noted that the distance between the left and right leg parts 21, 22 of the second leg 2 is less than the distance between the left and right leg parts 11, 12 of the first leg 1.

The backrest 3 includes elongate left and right backrest parts 31, 32, each of which has first and second end portions 311, 312, 321, 322. The first end portion 311, 321 of each of the elongate left and right backrest parts 31, 32 of the backrest 3 is coupled pivotally to the second end portion 212, 222 of a respective one of the left and right leg parts 21, 22 of the second leg 2.

It is noted that the distance between the elongate left and right backrest parts 31, 32 of the backrest 3 is less than the distance between the left and right leg parts 21, 22 of the second leg 2.

The seat-supporting frame 5 is generally U-shaped, and has first and second end portions 51, 52, and an intermediate portion 54 that interconnects the first and second end portions 51, 52 of the seat-supporting frame 5. The intermediate portion 54 of the seat-supporting frame 5 is provided with a pair of left and right lugs 541, 542, each of which is coupled pivotally to the second end portion 312, 322 of a respective one of the elongate left and right backrest parts 31, 32 of the backrest 3.

The foldable chair further includes a pair of second pivot joints 33. One of the second pivot joints 33 interconnects the elongate left backrest part 31 of the backrest 3 and the left lug 541 of the intermediate portion 54 of the seat-supporting frame 5. The other of the second pivot joints 33 interconnects the elongate right backrest part 32 of the backrest 3 and the right lug 542 of the intermediate portion 54 of the seat-supporting frame 5. In this embodiment, each of the second pivot joints 33 includes a bolt and a nut. In the alternative embodiment, each of the second pivot joints 33 includes a rivet.

Each of the first and second end portions 51, 52 of the seat-supporting frame 5 is coupled pivotally to the second end portion 112, 122 of a respective one of the left and right leg parts 11, 12 of the first leg 1.

The foldable chair further includes a pair of third pivot joints 53. One of the third pivot joints 53 interconnects the first end portion 51 of the seat-supporting frame 5 and the left leg part 11 of the first leg 1. The other of the third pivot joints 53 interconnects the second end portion 52 of the seat-supporting frame 5 and the right leg part 12 of the first leg 1. In this embodiment, each of the third pivot joints 53 includes a bolt and a nut. In the alternative embodiment, each of the third pivot joints 53 includes a rivet.

Each of the first and second safety locks 41, 42 includes a pair of lock parts 411, 412, 421, 422 that are coupled pivotally to each other. One of the lock parts 411 of the first safety lock 41 is coupled pivotally to the left leg part 11 of the first leg 1 at a position between the second end portion 112 and the pivot portion 113 of the left leg part 11 of the first leg 1. The other of the lock parts 412 of the first safety lock 41 is coupled pivotally to the second end portion 212 of the left leg part 21 of the second leg 2 and the first end portion 311 of the elongate left backrest part 31 of the backrest 3. One of the lock parts 421 of the second safety lock 42 is coupled pivotally to the right leg part 12 of the first leg 1 at a position between the second end portion 122 and the pivot portion 123 of the right leg part 12 of the first leg 1. The other of the lock parts 422 of the second safety lock 42 is coupled pivotally to the second end portion 222 of the right leg part 22 of the second leg 2 and the first end portion 321 of the elongate right backrest part 32 of the backrest 3.

The foldable chair further includes a pair of fourth pivot joints 43, a pair of fifth pivot joints 44, and a pair of sixth pivot joints 45. One of the fourth pivot joints 43 interconnects the lock parts 411, 412 of the first safety lock 41. The other of the fourth pivot joints 43 interconnects the lock parts 421, 422 of the second safety lock 42. One of the fifth pivot joints 44 interconnects one of the lock parts 411 of the first safety lock 41 and the left leg part 11 of the first leg 1. The other of the fifth pivot joints 44 interconnects one of the lock parts 421 of the second safety lock 42 and the right leg part 12 of the first leg 1. One of the sixth pivot joints 45 interconnects the other of the lock parts 412 of the first safety lock 41, the left leg part 21 of the second leg 2, and the elongate left backrest part 31 of the backrest 3. The other of the sixth pivot joints 45 interconnects the other of the lock parts 422 of the second safety lock 42, the right leg part 22 of the second leg 2, and the elongate right backrest part 32 of the backrest 3.

The first leg 1 further includes a crosspiece 14 that has first and second end portions 141, 142, each of which is connected to the second end portion 112, 122 of a respective one of the left and right leg parts 11, 12 of the first leg 1.

Figure 5:
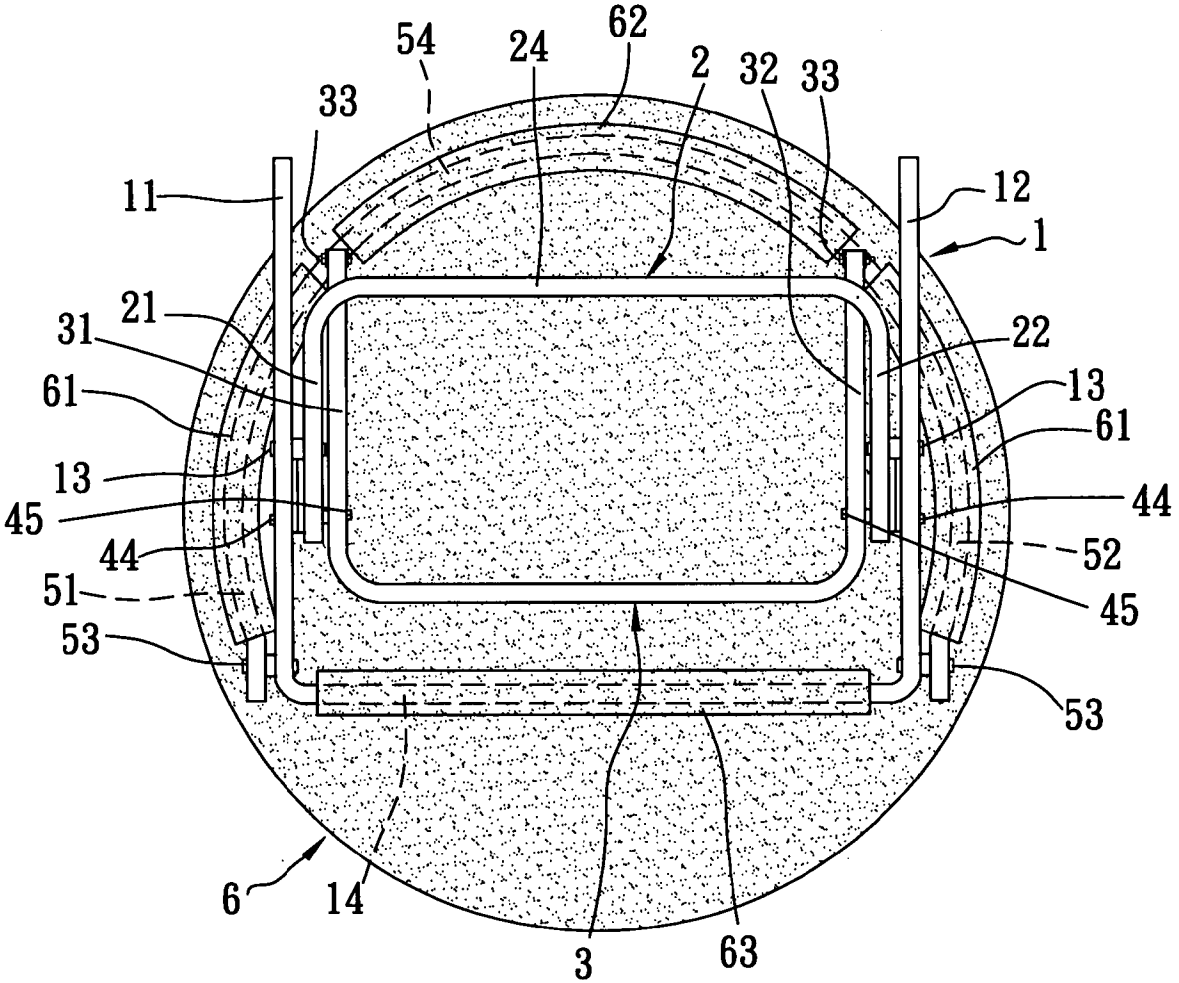
FIG. 5 is a schematic top view of the preferred embodiment in a folded state.

The foldable chair further includes a flexible seat 6 that serves to support a user (not shown). As best shown in FIG. 5, the seat 6 has a pair of first connecting portions 61, each of which is wrapped around the first and second end portions 51, 52 of the seat-supporting, frame 5, a second connecting portion 62 wrapped around the intermediate portion 54 of the seat-supporting frame 5, and a third connecting portion 63 wrapped around the crosspiece 14 of the first leg 1.

Figure 3:
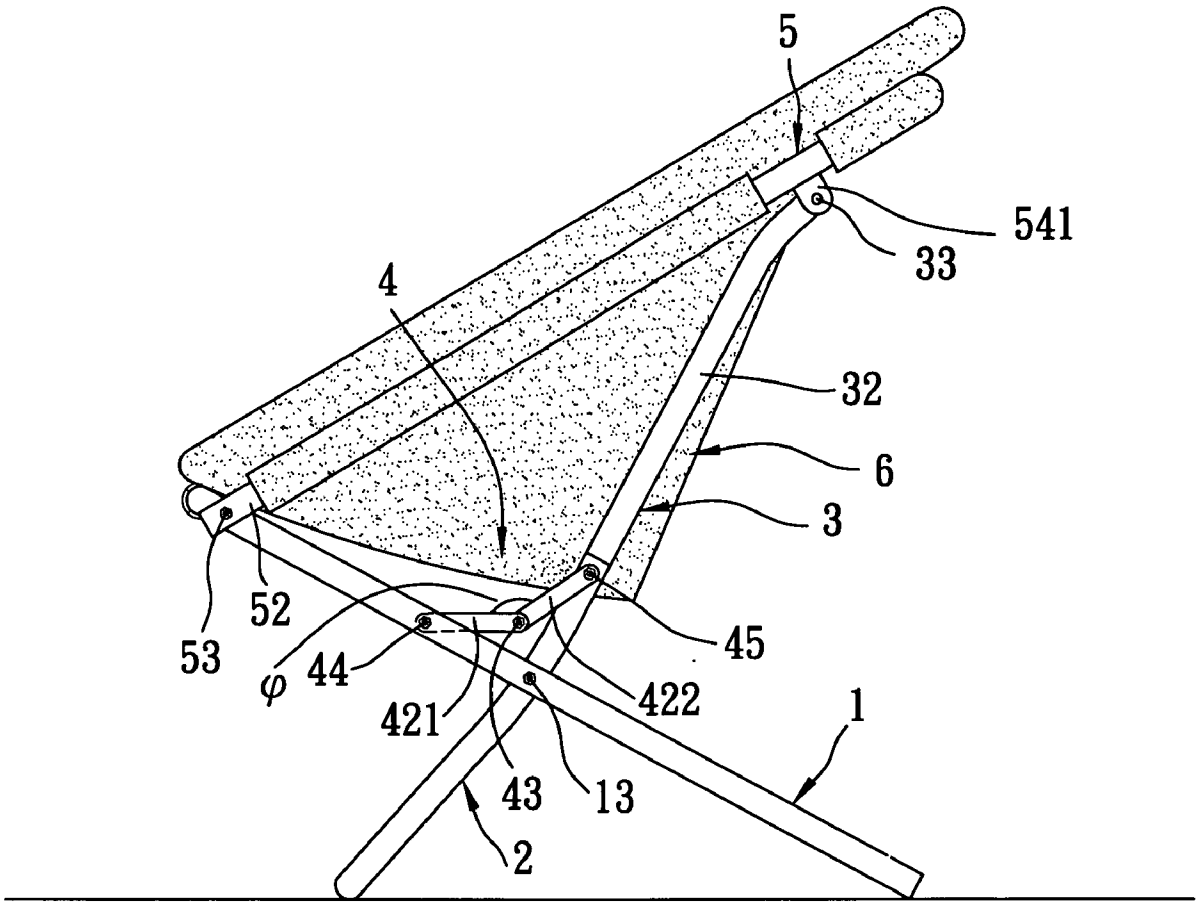
FIG. 3 is a schematic side view of the preferred embodiment to illustrate operation of a safety lock.
Figure 4:
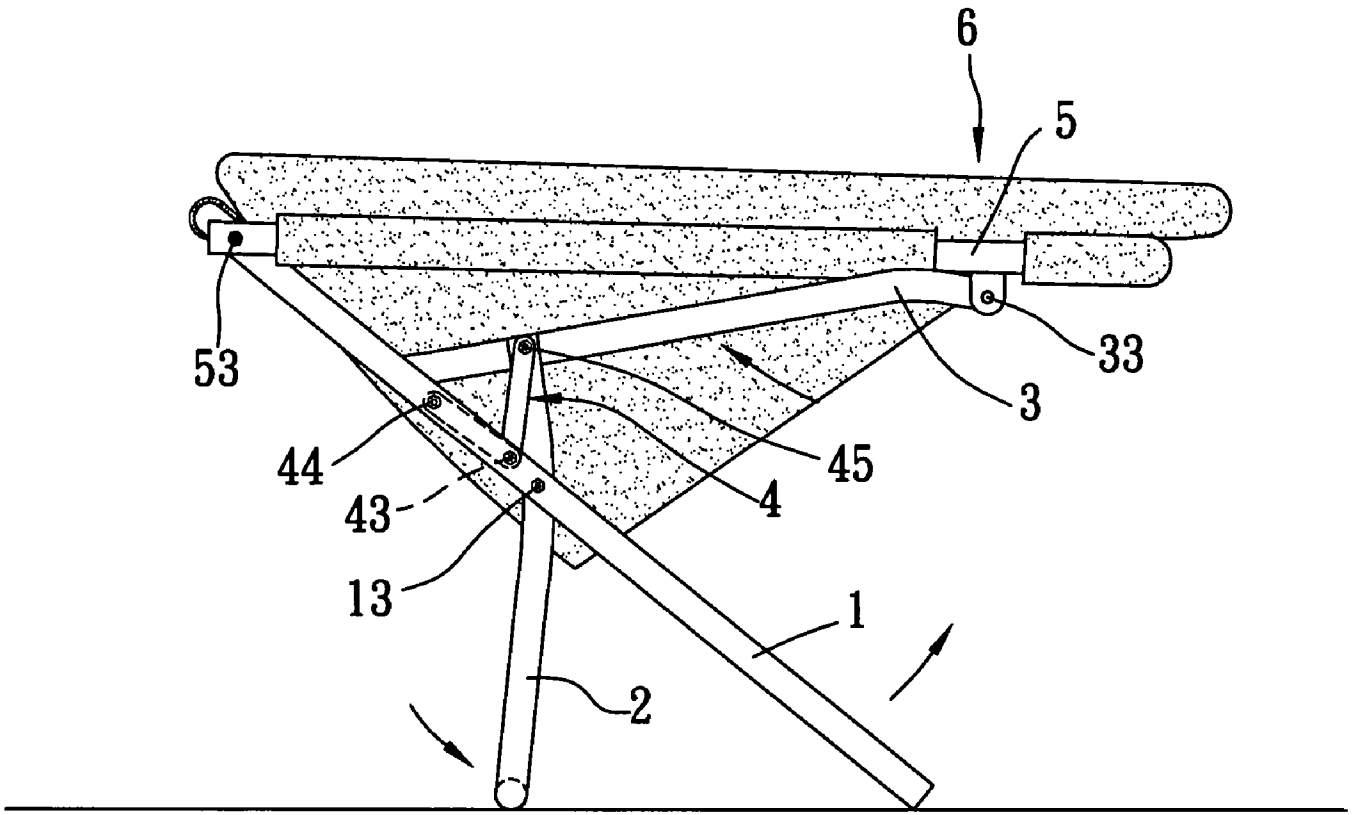
FIG. 4 is a schematic side view of the preferred embodiment illustrating relative positioning among first and second legs, a backrest, and a seat-supporting frame during a folding operation.

As best shown in FIG. 2, when the foldable chair is unfolded, the first and second legs 1, 2 form a predetermined angle ($\theta$) therebetween. Moreover, the second leg 2 and the backrest 3 form a 180-degree angle therebetween. Further, the lock parts 411, 412, 421, 422 of each of the first and second safety locks 41, 42 form a 180-degree angle therebetween. At this position, the first and second safety locks 41, 42 prevent accidental folding of the foldable chair of this invention. Furthermore, the first and second safety locks 41, 42 prevent movement of the first and second legs 1, 2 away from each other. At this time, when it is desired to fold the foldable chair of this invention, the first and second safety locks 41, 42 are operated such that the lock parts 411, 412, 421, 422 of each of the first and second safety locks 41, 42 form an obtuse angle ($\phi$) therebetween, as best shown in FIG. 3 (only the second safety lock 42 is shown), so as to permit movement of the first and second legs 1, 2, and the backrest 3 toward the seat-supporting frame 5, as best shown in FIG. 4, thereby folding the foldable chair of this invention, as best shown in FIG. 5.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable chair comprising:

a first leg including left and right leg parts, each of which has first and second end portions and a pivot portion between said first and second end portions of a respective one of said left and right leg parts of said first leg;

a second leg including left and right leg parts, each of which has first and second end portions and a pivot portion between said first and second end portions of a respective one of said left and right leg parts of said second leg, said pivot portion of each of said left and right leg parts of said second leg being coupled pivotally to said pivot portion of a respective one of said left and right leg parts of said first leg;

a backrest including elongate left and right backrest parts, each of which has first and second end portions, said first end portion of each of said elongate left and right backrest parts being coupled pivotally to said second end portion of a respective one of said left and right leg parts of said second leg;

a seat-supporting frame having first and second end portions, and an intermediate portion that interconnects said first and second end portions of said seat-supporting frame, each of said first and second end portions of said seat-supporting frame being coupled pivotally to said second end portion of a respective one of said left and right leg parts of said first leg, said intermediate portion of said seat-supporting frame being coupled pivotally to said second end portions of said elongate left and right backrest parts of said backrest; and first and second safety locks, each of which prevents accidental folding of said foldable chair, each of said first and second safety locks including a pair of lock parts that are coupled pivotally to each other;

wherein one of said lock parts of said first safety lock is coupled pivotally to said left leg part of said first leg at a position between said second end portion and said pivot portion of said left leg part of said first leg, the other of said lock parts of said first safety lock being coupled pivotally to said second end portion of said left leg part of said second leg; and wherein one of said lock parts of said second safety lock is coupled pivotally to said right leg part of said first leg at a position between said second end portion and said pivot portion of said right leg part of said first leg, the other of said lock parts of said second safety lock being coupled pivotally to said second end portion of said right leg part of said second leg.

2. The foldable chair as claimed in claim 1, further comprising a flexible seat adapted for supporting a user, said seat having a plurality of connecting portions wrapped around said seat-supporting frame and said first leg.

* * * * *